US010399749B1

(12) United States Patent
Walker et al.

(10) Patent No.: US 10,399,749 B1
(45) Date of Patent: Sep. 3, 2019

(54) LID FOR A FLAT BACK BUCKET

(71) Applicant: Robin E. Walker, Chicago, IL (US)

(72) Inventors: Robin E. Walker, Chicago, IL (US); Randolph J. Schafernak, Arlington Heights, IL (US)

(73) Assignee: Robin E. Walker, Chicago, IL (US)

( * ) Notice: Subject to any disclaimer, the term of this patent is extended or adjusted under 35 U.S.C. 154(b) by 44 days.

(21) Appl. No.: 15/053,050

(22) Filed: Feb. 25, 2016

Related U.S. Application Data

(60) Provisional application No. 62/120,484, filed on Feb. 25, 2015.

(51) Int. Cl.
*B65D 43/22* (2006.01)
*B65D 43/16* (2006.01)

(52) U.S. Cl.
CPC ..... *B65D 43/22* (2013.01); *B65D 43/16* (2013.01)

(58) Field of Classification Search
CPC ..... B65D 43/22; B65D 43/16
USPC ..... 220/780
See application file for complete search history.

(56) References Cited

U.S. PATENT DOCUMENTS 1,031,015 A 7/1912 Lundgaard
4,946,057 A 8/1990 Connolly et al.
5,345,784 A * 9/1994 Bazemore ..... A47G 23/04 62/371
5,452,820 A 9/1995 Mislavsky
5,870,969 A 2/1999 Boyce
6,851,569 B2 * 2/2005 Conti ..... B65D 21/0219 215/216
6,866,172 B2 * 3/2005 Shackelford ..... A45F 5/00 220/695
7,201,355 B1 4/2007 Zien et al.
7,578,411 B1 8/2009 Zien et al.
8,733,585 B2 * 5/2014 Abdi ..... B65D 25/287 220/254.6
2004/0188451 A1 * 9/2004 Karlsson ..... B65D 25/28 220/754
2008/0190951 A1 * 8/2008 Gallagher ..... B65D 21/0233 220/826

OTHER PUBLICATIONS

E-Z on Bucket Covers, SmartPak Equine, http://www.smartpakequine.com, retrieved Feb. 24, 2016. Admitted Prior Art.

(Continued)

*Primary Examiner* — Anthony D Stashick
*Assistant Examiner* — Raven Collins
(74) *Attorney, Agent, or Firm* — Greer, Burns & Crain, Ltd.

(57) ABSTRACT

A lid for a flat back bucket comprises a rear lid portion that has a flat back configured to match the flat back of the bucket, a front lid portion, and a plurality of tabs configured to clip the lid to a rim channel of the bucket. The front and rear lid portions are preferably hingedly connected to each other. Plural cut outs or openings are provided in the rear lid portion that are configured to receive, respectively, bail mounts on the bucket. Lips extend from the rear and front lid portions and are positioned so that the lips will be exterior of and overhang the rim channel of the bucket when the lid is on the bucket.

12 Claims, 15 Drawing Sheets

(56) References Cited

OTHER PUBLICATIONS

All Terrain Bucket System, Just HorsN Around, LLC, http://justhorsnaround.com. retrieved Feb. 24, 2016. Admitted Prior Art.
Lids for Vikan Pails, Contractor Supply Net Work, http://contractorsupplynetwork.com, retrieved Feb. 24, 2016. Admitted Prior Art.
Brabantia Flatback Fingerprint Proof Bin, Mummy Melton, http://mummymelton.blogsport.com/2013/11/review-brabantia-flatback-fingerprint.html, retrieved Feb. 24, 2016. Admitted Prior Art.
Lid for Bucket, Vikan Products, http://www.vikan.com/uk/all-products/detail/?gid=7820&id=1957, retrieved Feb. 24, 2016. Admitted Prior Art.

* cited by examiner

LID FOR A FLAT BACK BUCKET

PRIORITY

Applicant claims priority to the U.S. provisional patent application Ser. No. 62/120,484 filed Feb. 25, 2015.

BACKGROUND OF THE INVENTION

Flat back buckets have been used for many years on ranches and farms, especially in connection with horse stables. The conventional flat back bucket is a semi-circular in plan view with one side that is straight or slightly bowed inward, which defines the flat back. Conventional buckets are typically tapered, having a smaller diameter at the bottom and larger diameter at the top. The top includes a rim channel Conventional buckets also have a bail which is attached to a pair of U-shaped mounts secured to the bucket rim channel along a centerline of the bucket parallel to the flat back.

One problem with prior art flat back buckets is that the buckets are sold without lids. Without lids, it is not feasible to store water or feed in the buckets due to the risk of contamination and/or rodent or insect infestation. Further, without lids, it is not possible to stack buckets that contain water or feed.

Attempts have been made provide lids for flat back buckets, but have not been entirely satisfactory. One known attempt is a soft fabric cover having a pair of slits for receiving the U-shaped mounts and bail. Fabric covers are not entirely satisfactory because they cannot support the weight of another bucket and provide only limited protection for rodents, insects and debris. Another attempt to provide a lid for flat back bucket was to change the bucket design, namely mounting the bail on the side of the bucket instead of the rim channel Thereby the rim channel was free of the bail mount so that a conventional plastic cover could be secured to the rim channel. This later design although somewhat successful, does not solve the problem of providing a lid for conventional flat back buckets with a bail mount on the rim channel.

Accordingly, there is a need for an improved cover for a flat back bucket that increases the usefulness of standard buckets.

SUMMARY OF THE INVENTION

In accordance with the invention, a lid for a flat back bucket is provided. The standard flat back bucket has a flat back, a rim channel and plural bail mounts in the rim channel. The lid comprises a substantially rigid center lid portion with a top surface and a bottom surface, peripheral margins of the bottom surface being configured to engage the top of the bucket rim channel when the lid is attached to the bucket. The center lid portion has a flat back to match the bucket flat back and optionally may have a recessed center portion to receive the bottom of another bucket in stacked relationship. A lip extends from the center lid portion and is positioned to be exterior of and overhang the bucket rim channel Plural cut outs or openings are provided in the peripheral margin of the central lid portion configured to receive, respectively, the plural bail mounts of the bucket. A plurality of locking tabs are configured to engage the rim channel of the bucket to secure the lid to the rim channel of the bucket.

In another embodiment, a lid for a bucket, with or without a flat back, comprises a substantially rigid rear lid portion with a top surface and a bottom surface, and a substantially rigid front lid portion hingedly connected to the rear lid portion so that it can be pivoted between open and closed positions. Peripheral margins of the bottom surfaces of the rear and front lid portions are configured to engage the rim channel of the bucket when the lid is attached to the bucket. Plural cut outs are provided in the peripheral margins of at least one of the rear and front lid portions and are configured to receive, respectively, the plural bail mounts. A plurality of locking tabs are configured to engage the rim channel of the bucket to secure the lid to the rim channel of the bucket.

In yet another embodiment, a lid for a flat back bucket comprises a rear lid portion with a flat back that is configured to match the flat back of the bucket, and a front lid portion hingedly connected to the rear lid portion so that it can pivot between open and closed positions. Both of the rear and front lid portions have top and bottom surfaces. A plurality of tabs are configured to secure at least the rear lid portion to the rim channel of the bucket. A plurality of ribs are arranged on the bottom surface of the front and rear lid portions interior of the rim channel when the lid is secured to the bucket rim channel Plural cut outs are provided in the rear lid portion to receive, respectively, the bail mounts. The plural cut outs are positioned on a first axis that is parallel to the flat back of the rear lid portion. Lips extend from the front lid portion and rear lid portion and are arranged and positioned so that the lips will be exterior of and overhang the rim channel of the flat back bucket when the lid is secured to the bucket. The rim channel is received between the ribs and lips, when the lid is in place on the bucket. Preferably, the hinged connection between rear and front lid portions lies on a second axis that is substantially parallel to and in between the first axis and flat back of the lid.

Accordingly, the several lid embodiments of the invention solve one or more problems in the prior art; namely, providing enhanced protection for and reduce risk of contamination and/or rodent or insect infestation; facilitating stacking buckets that contain water or feed; and permitting universal use on existing buckets made by multiple manufacturers without any modification to the bucket design.

DETAILED DESCRIPTION

Figure 1:
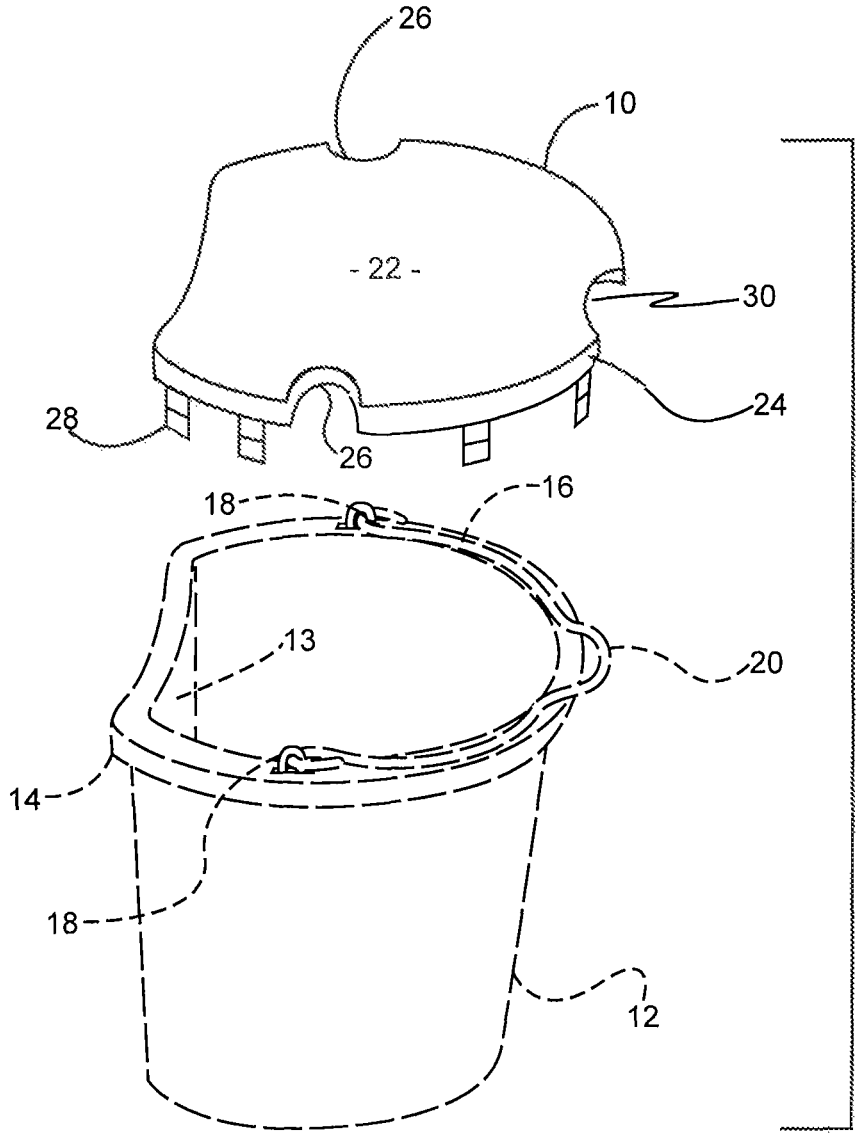
FIG. 1 is a perspective view of a bucket lid and a flat back bucket.

Turning now to the drawings, FIG. 1 is an exploded perspective view of a bucket lid 10 over a conventional flat back bucket 12. The bucket includes a flat back 13, rim channel 14, a bail 16, and plural bail mounts 18 that are secured to the rim channel 14. The bail has a hook 20. Although preferred embodiments of the invention as described below are directed to lids for flat back buckets, the same concepts and features can be applied to buckets of other shapes, including round buckets and pails, and the invention as defend by the appended claims is not, unless expressly stated, limited to lids for flat back buckets.

Figure 2:
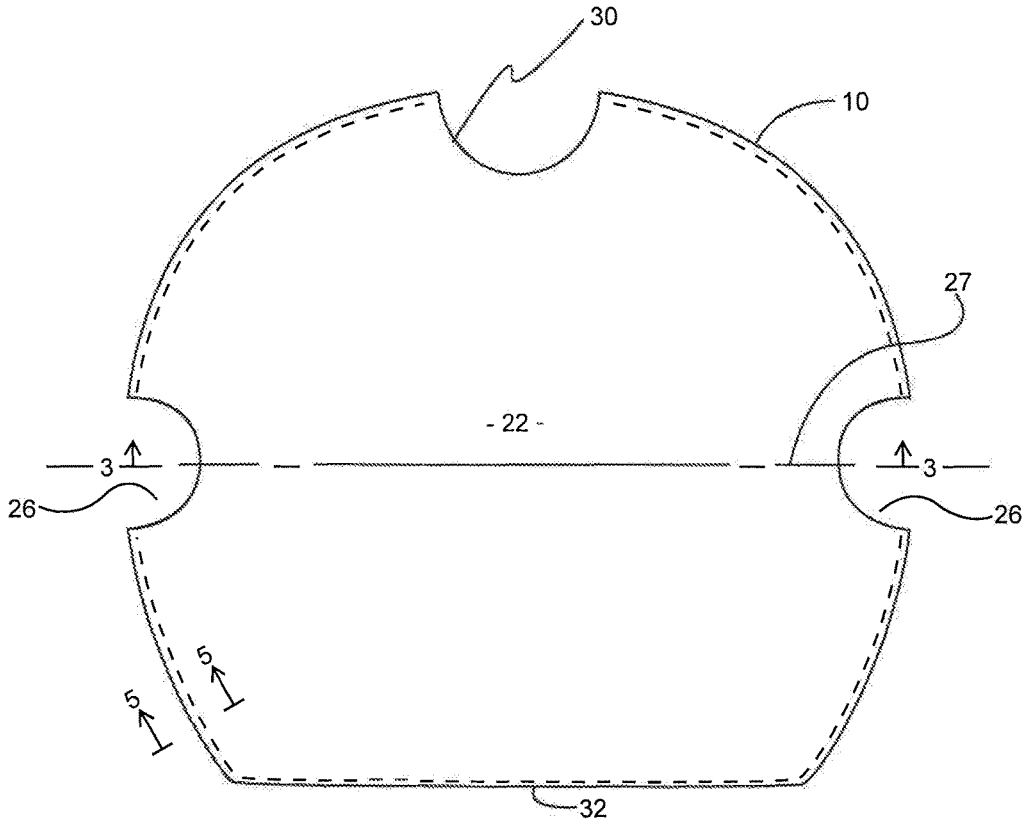
FIG. 2 is a top plan view of the lid.
Figure 3:
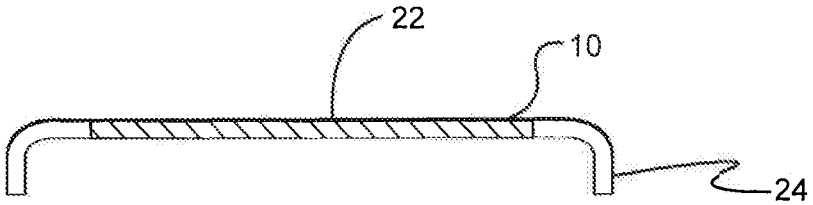
FIG. 3 is a cross-sectional view of the bucket lid taken along line 3-3 of FIG. 2.

As shown in FIGS. 1-3, the lid 10 comprises a center portion 22, overhanging lip 24, a pair of side cutouts 26, at least one, preferably two or more locking tabs or clips 28 and an optional bail hook cutout 30. The lid has a flat back 32 that matches the flat back 13 of the bucket. The lid central portion 22 can be flat as shown or can include a recess that is sized and configured to receive the bottom of another bucket. The two side cutouts 26 are opposite each other and aligned with each other on an axis 27 that is substantially parallel to the flat back 32. The lid is dimensioned and configured to fit securely over the top of the bucket. As shown in FIGS. 1-4, a peripheral margin of the bottom surface of the lid 10 engages the top of the bucket rim channel 14, and the lip 24 extends downwardly exterior of the rim channel. Further, because many manufactures of flat back buckets produce buckets in substantially standard sizes, the lid of the invention is preferably dimensioned and configured as a universal lid that can be used with multiple brands of flat back buckets.

The lid 10 is secured to the rim channel 14 of the bucket by tabs or clips 28 that in the first embodiment are integral with and extend downwardly from lip 24 of the lid, and are configured to engage the bottom 34 of the bucket rim channel. The optional front cutout 30 in the lid provides room to easily grasp the bail hook 20.

The lid is preferably molded from a substantially rigid, durable plastic or plastic-rubber blend, most preferably from the same material as bucket. The lid material is preferably a food grade material.

Figure 4A:
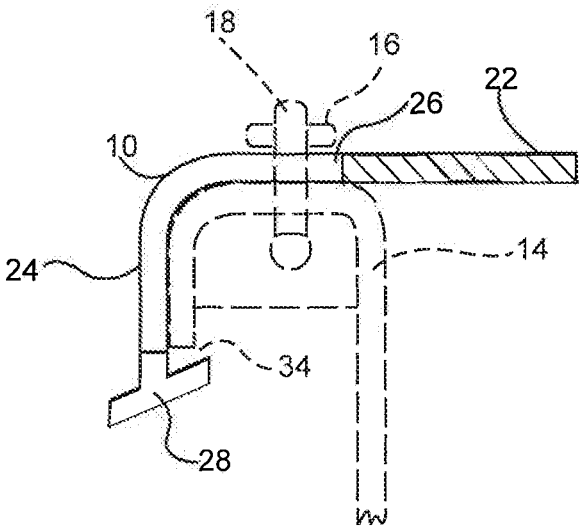
FIG. 4*a* is a cross-sectional view of the bucket lid at an opening in a peripheral margin of the bucket lid.

FIG. 4*a* is a detailed cross sectional view of one side of the lid taken along the same line as FIG. 3. The bucket rim channel 14, bail 16 and bail mount 18 are shown in dashed lines. As illustrated, the cutout 26 provides sufficient space to avoid interference of the lid with bail 16 or bail mount 18. However, the lid central portion 22 extends outwardly a sufficient distance so that the bottom surface of the lid engages the top inside portion of the rim channel 14 to provide an effective seal with the rim channel.

Figure 4B:
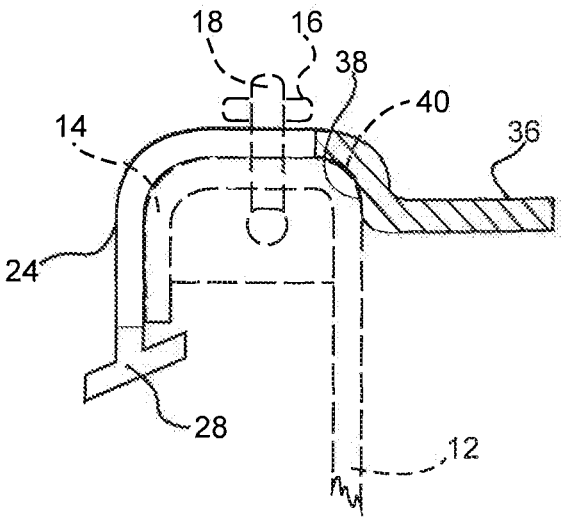
FIG. 4*b* is a cross-sectional view of a second embodiment of the bucket lid at an opening in a peripheral margin of the bucket lid.

FIG. 4*b* is an alternate (second) embodiment of the lid wherein the central portion 22 of the lid is recessed inwardly. This performs a dual function, namely to provide a nesting recess 36 for the bottom of another bucket (not shown) to facilitate stacking of two or more buckets; and to provide an enhanced seal with the rim channel More specifically, an outer bottom surface 38 of the recessed portion 36 is dimensioned and configured to fit snugly into an inner surface 40 of the rim channel 14 to provide at least a partial seal.

Figure 5:
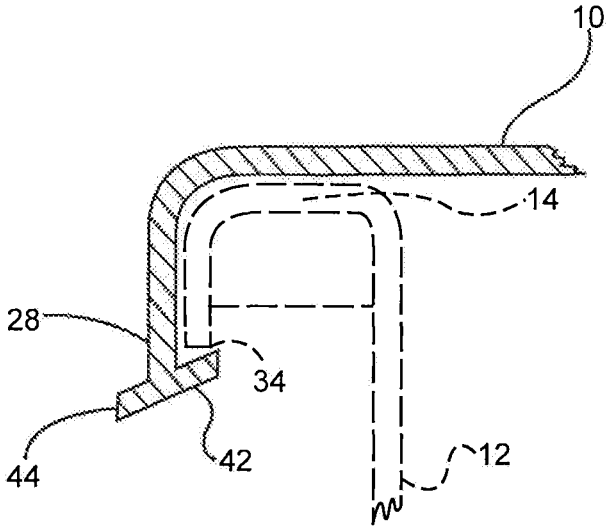
FIG. 5 is a cross-sectional view of the bucket lid and locking tab taken along line 5-5 of FIG. 2.

FIG. 5 is a detailed cross-sectional view through a locking tab 28 taken along line 5-5 of FIG. 2. The tab 28 extends from the overhanging lip 24, and includes a clip 42 to releasably engage the bottom 34 of the bucket rim channel 14 and thumb grip 44 to release the tab. The lid may contain any number of tabs, preferably two on opposite sides of the lid. The illustrated tab 28 is only one embodiment of a locking tab. Other tab configurations can be used in lieu of the illustrated tab embodiment, as will be well known and apparent to those skilled in the art.

Figure 6:
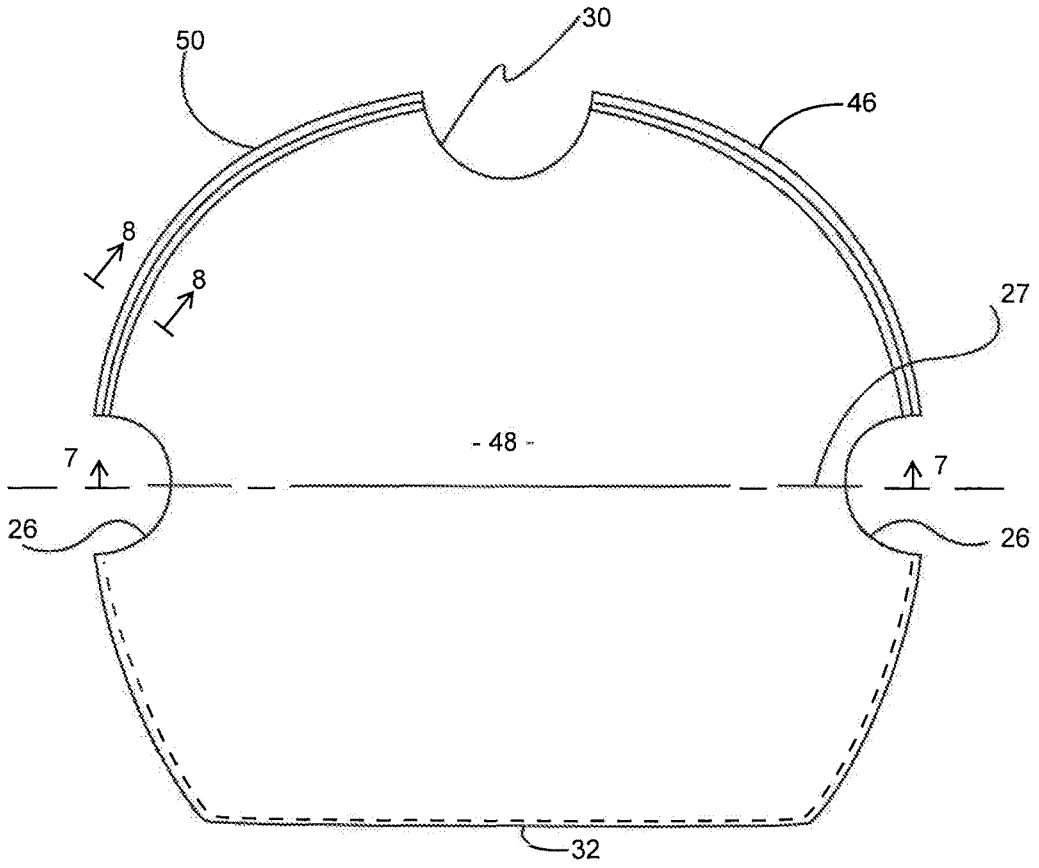
FIG. 6 is a top plan view of a third embodiment of the bucket lid.
Figure 7:
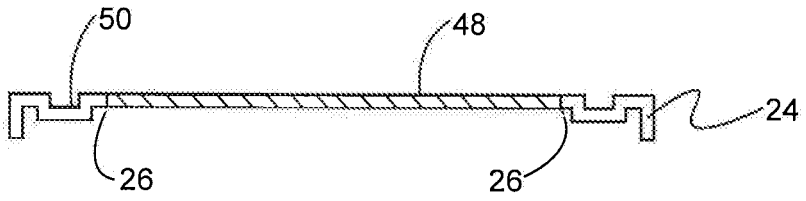
FIG. 7 is a cross-sectional view of a third embodiment of the bucket lid taken along line 7-7 of FIG. 6.
Figure 8:
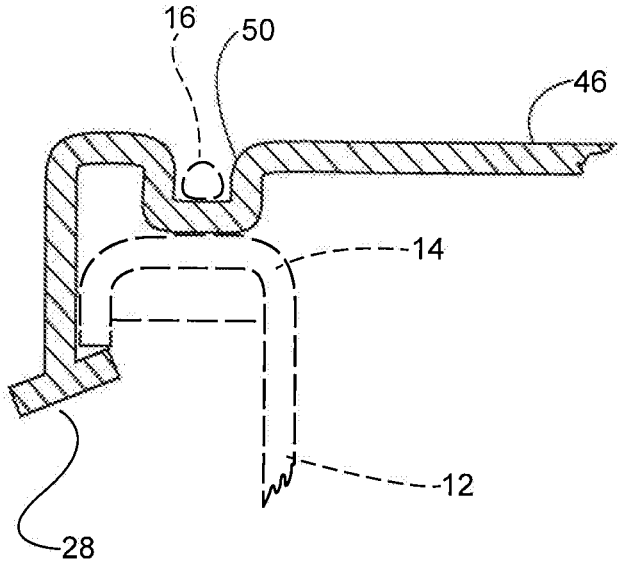
FIG. 8 is a cross-sectional view of the third embodiment of the bucket lid and locking tab at a peripheral margin of the bucket lid taken along line 8-8 of FIG. 6.

FIGS. 6-8 illustrate a third embodiment of a bucket lid 46 of the invention. This embodiment differs from the first embodiment in that it has a raised lid central portion 48 having a groove 50 for receiving the bail 16, whereby the top surface of the bucket is substantially flush. Like the first embodiment, the second embodiment has an overhanging lip 24, flat or concave back 32, a pair of side cutouts 26 opposite each other, and an optional front cutout 30 that can receive the bail hook 20. Side cutouts 26 are aligned with each other on an axis 27 parallel to the flat back 32 of the lid. As in the first embodiment, the lid is secured to the rim channel of the bucket by tabs 28 that extend from lip 24 of the lid, and are configured to engage the bottom 34 of the bucket rim channel 14. In FIG. 8 the bucket rim channel 14, and bail 16 are shown in dashed line. A tab 28 extends downwardly from the overhanging lip 24 such that the lid can be secured by fastening the tab to the bottom 34 of the bucket rim channel 14.

Figure 9:
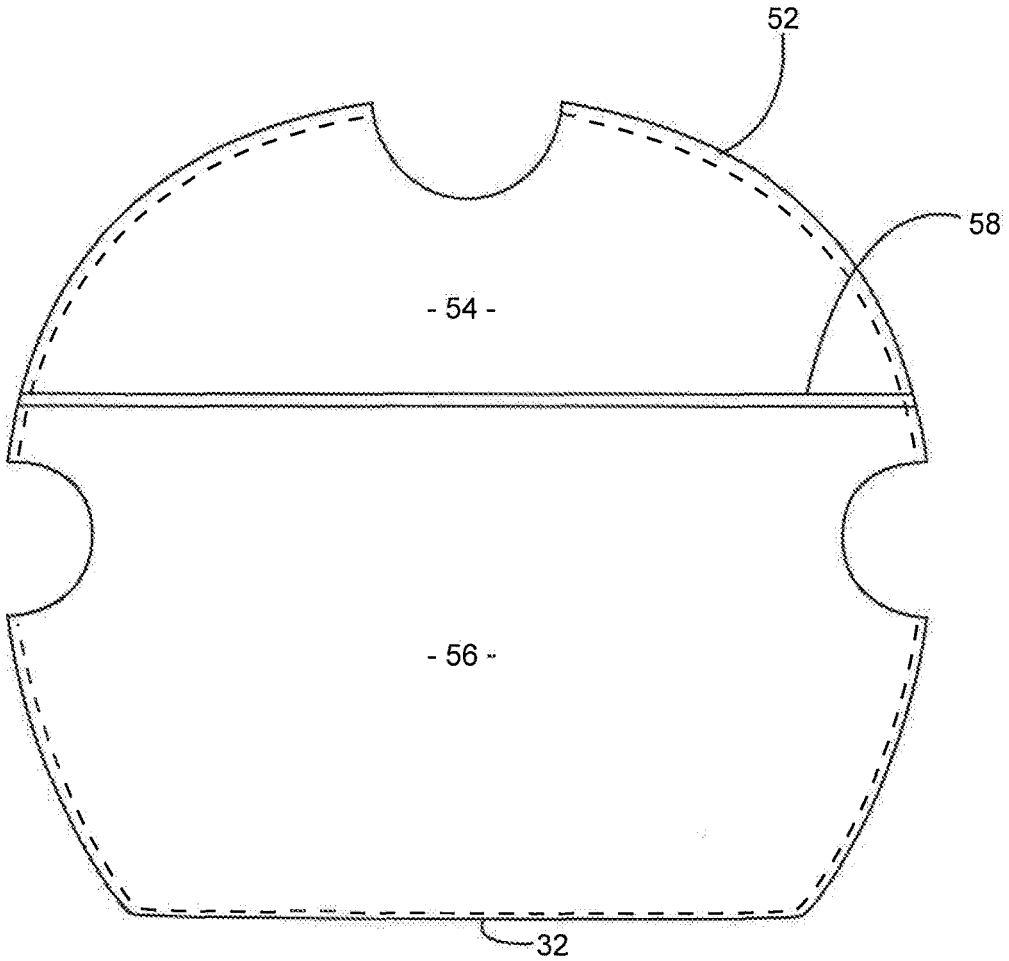
FIG. 9 is a top plan view of a hinged fourth embodiment of the bucket lid.
Figure 10:
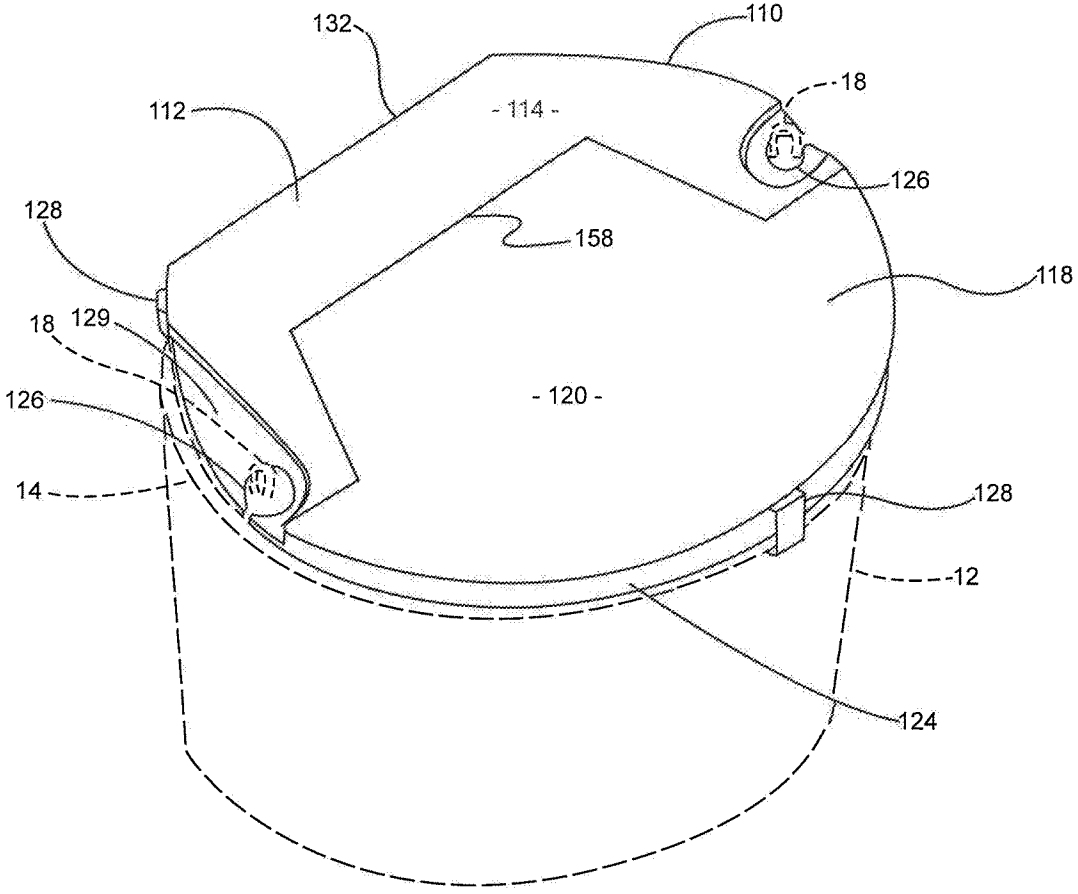
FIG. 10 is a perspective view of a hinged fifth embodiment of the bucket lid.
Figure 11:
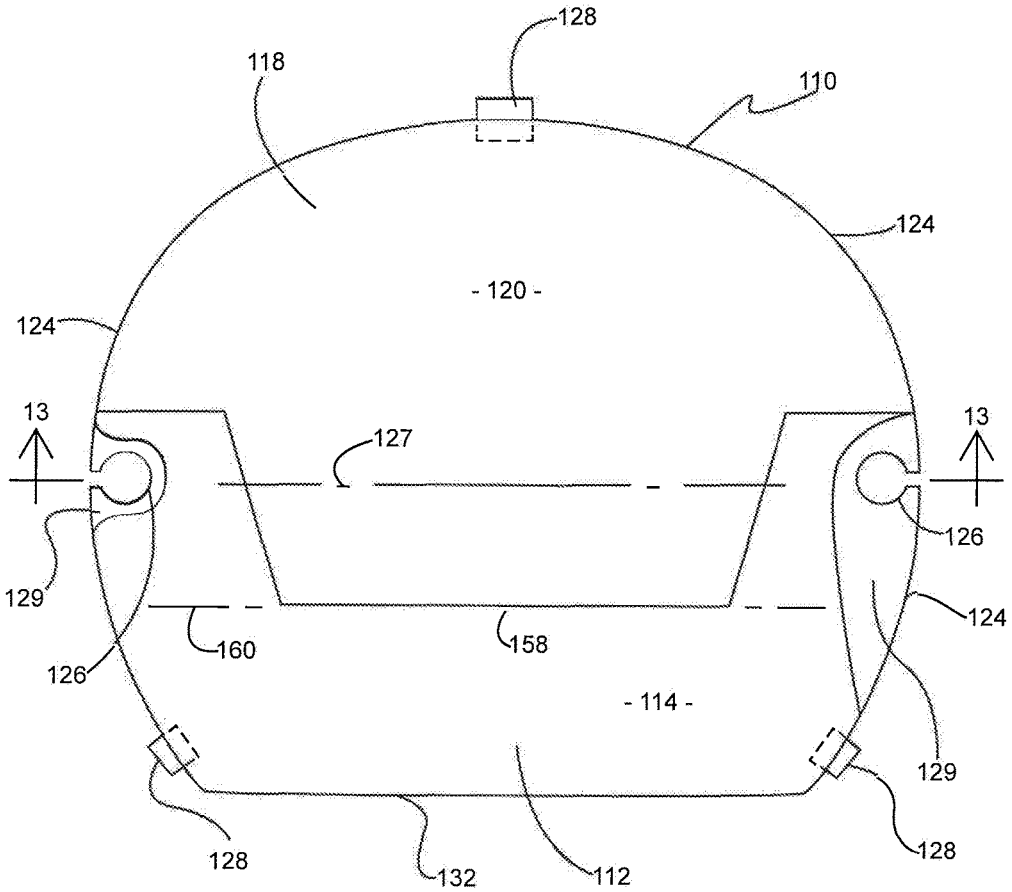
FIG. 11 is a top plan view of the fifth embodiment of the bucket lid.

FIG. 9 is a top plan view of a fourth embodiment of the bucket lid 52 in which the front portion of the lid 54 is attached to the rear portion 56 by a hinge 58 which allows the front portion to be lifted up independently of the rear portion. The hinge 58 lies on a second axis 60 that is substantially parallel to the flat back 32 of the lid. FIGS. 10-17 illustrate a fifth embodiment 110 of the bucket lid. The lid 110 comprises a rear lid portion 112 with a top surface 114 and a bottom surface 116, a front lid portion 118 that is preferably hingedly connected to the rear lid portion 112 so that it can be pivoted between open and closed positions. The front lid portion 118 has a top surface 120 and a bottom surface 122. Lips 124 extend downwardly from both the front lid portion and rear lid portion and are configured to be exterior of bucket rim channel 14. Peripheral margins 125 of the bottom surfaces of the rear and front lid portions are configured to engage the rim channel 14 of the bucket 10 when the lid 110 is attached to the bucket. Plural cut outs or openings 126 in the peripheral margins of one of the lid portions, preferably the rear lid portion, are configured to receive, respectively, the plural bail mounts 18. The cutouts lie on an axis 127 that is substantially parallel to the flat back 132. The lid portions are preferably fabricated from substantially rigid plastic as described above. In a more preferred embodiment the rear lid portion includes a flex zone 129 that permits the rear lid portion to be flexed or bowed to facilitate placement of the rear lid portion over the bail mounts and onto the rim channel. An example flex zone is an area of reduced thickness of the rear lid portion adjacent one or both of the cutouts for the bail mounts. Other flex zone designs and functional equivalents will be apparent to persons skilled in the art.

Preferably a hinge 158 connects the rear lid portion 112 and the front lid portion 118. The hinged connection is preferably located on a second axis 160 parallel to and between the first axis 127 and flat back 132. As a result, the access opening when the front portion is raised is greater. Preferably the rear lid portion is provided with flanges 123 to assist in supporting the front lid portion when in a closed position. A more preferred hinge, best shown in FIGS. 15*b*, 15*c* and 17*c*, comprises one or more a rod sections 159 on one lid portion and one or more mating open claw sections 161 on the other lid portion. The claw section is removable from the rod section so that the front lid portion can be separated and removed from the rear portion and later snapped back in place. Other pivoting means can be provided to hingedly connect the lid portions, as will be known to persons skilled in the art. Optionally, the rear and front lid portions can be separate parts, i.e., it is not required that they be hingedly connected.

Figure 12:
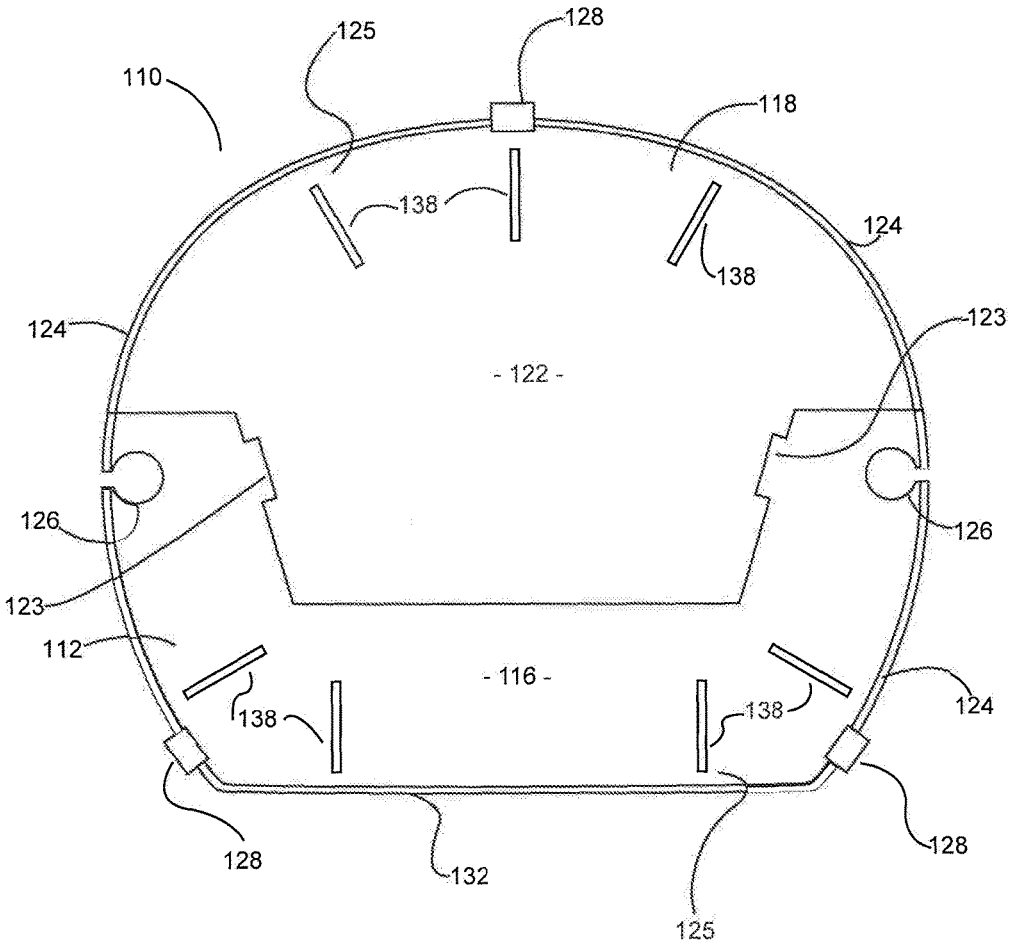
FIG. 12 is a bottom plan view of the fifth embodiment of the bucket lid.
Figure 13:
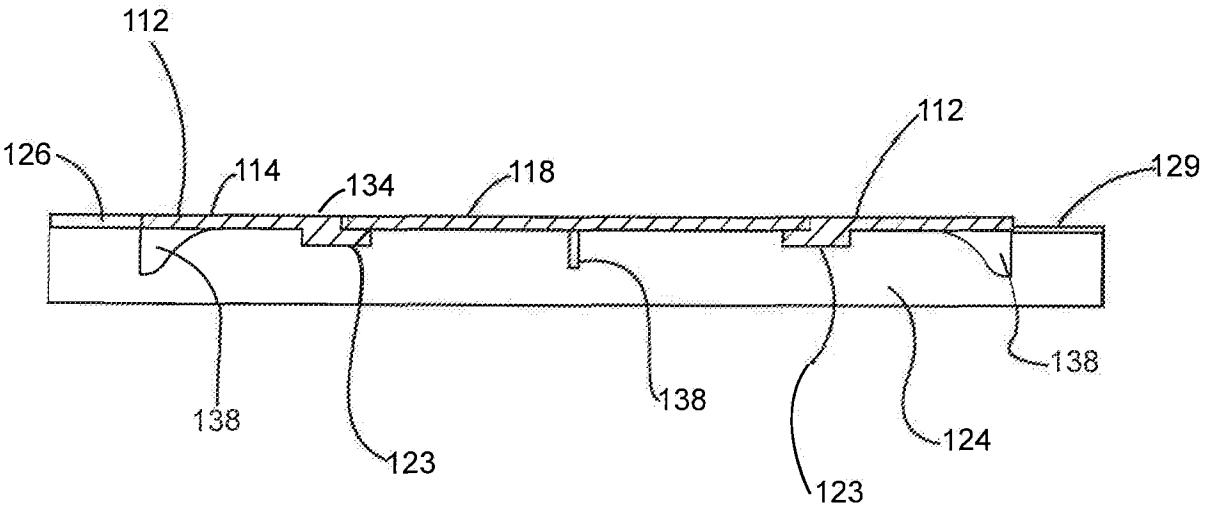
FIG. 13 is a cross-sectional view taken along line 13-13 of FIG. 11.

Turning now to FIGS. 12 and 13, a lip 124 extends downwardly from the rear lid portion and the front lid portion and is positioned to be exterior of and overhang the rim is channel of the bucket. A plurality of ribs 138 extend downwardly from the bottom surface of the rear lid portion 116, and the bottom surface of the front lid portion 122. Ribs 138 are positioned relative to lips 124 to form a slot or gap for receiving the rim channel 14 of the bucket 12. One or more locking tabs or clips 128 are configured to secure the lid 110 to the rim channel of the bucket.

Figure 14:
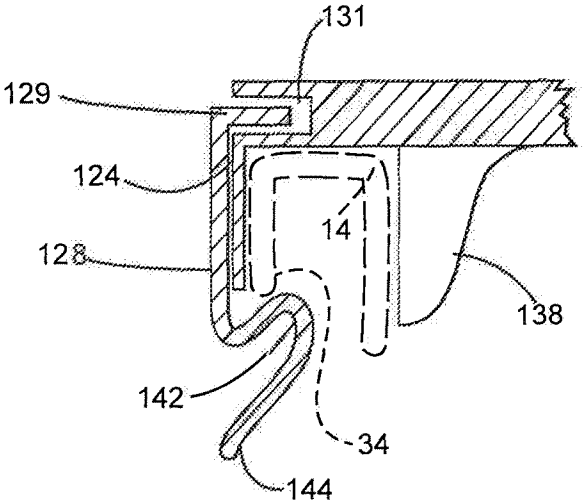
FIG. 14 is a cross-sectional view of the locking tab of the fifth embodiment taken along line 14-14 of FIG. 9.

FIG. 14 is a cross-sectional view of a preferred embodiment of a separate, non-integral locking tab 128. Tab 128 has a flat top portion 129 that is configured to be removably inserted into a receiving slot 131 in lid 110. Optionally, the tab can snap permanently into the slot such that it cannot be removed once inserted. A lower or clip portion 142 of the tabs is configured to engage the bottom 34 of the bucket rim channel. The clip includes a thumb grip 144 to release the clip.

Figure 15A:
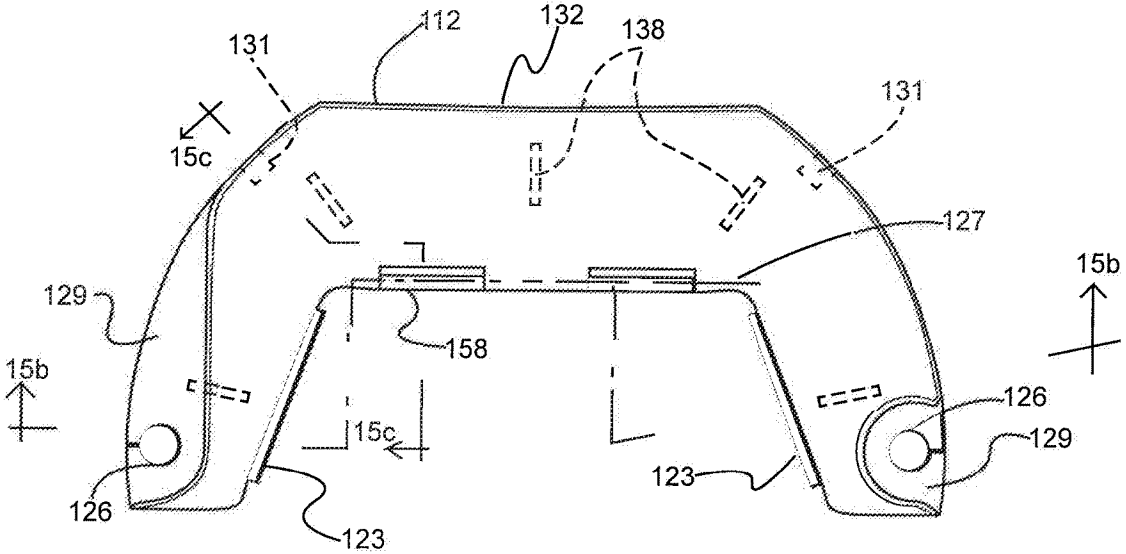
FIG. 15*a* is a plan view of the rear lid portion of the fifth embodiment.
Figure 15B:
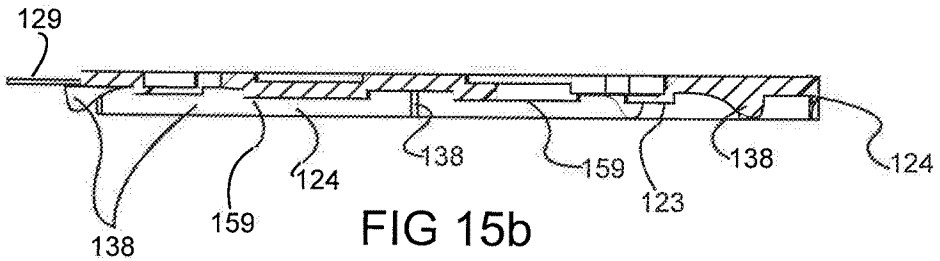
FIG. 15*b* is a partial cross-sectional view of the rear lid portion taken along line 15*b*-15*b* of FIG. 15*a*.
Figure 15C:
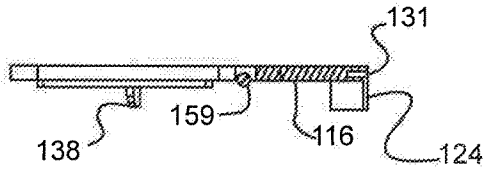
FIG. 15*c* is a partial cross-sectional view of the rear lid portion taken along line 15*c*-15*c* of FIG. 15*a*.
Figure 16A:
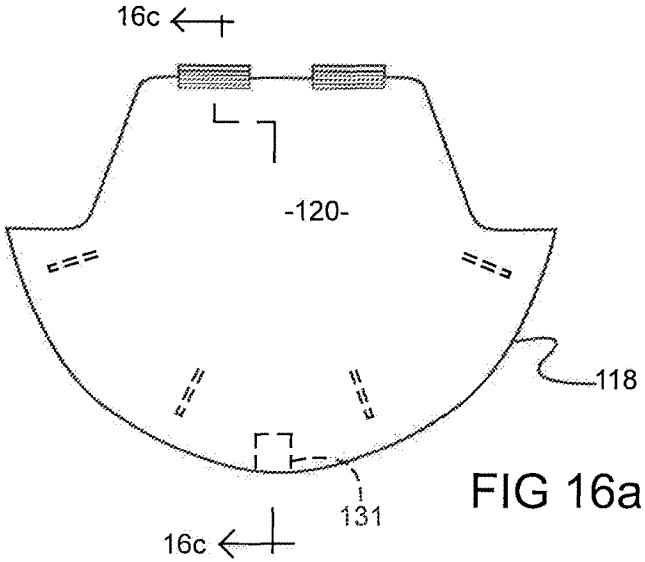
FIG. 16*a* is a plan view of the front lid portion of the fifth embodiment.
Figure 16B:
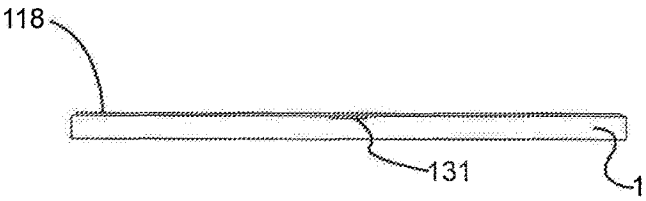
FIG. 16*b* is a front elevational view of the front lid portion.
Figure 16C:
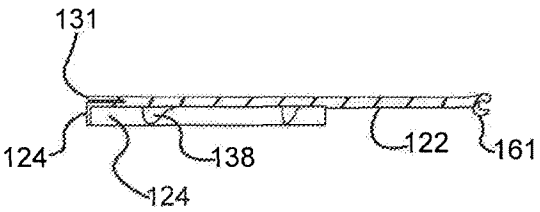
FIG. 16*c* is a cross-sectional view of the front lid portion taken along line 16*c*-16*c* of FIG. 16*a*.
Figure 17B:
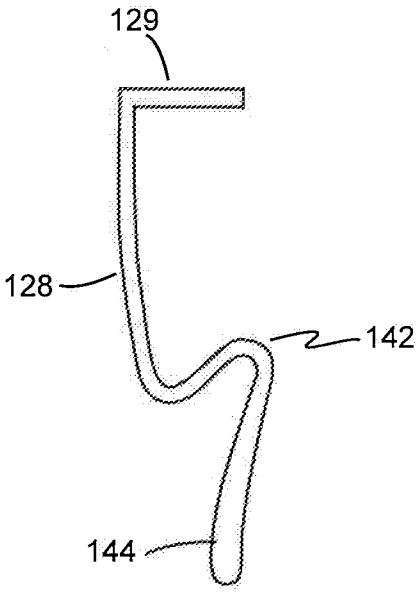
FIG. 17*b* is a side elevational view of the locking tab or clip.
Figure 17A:
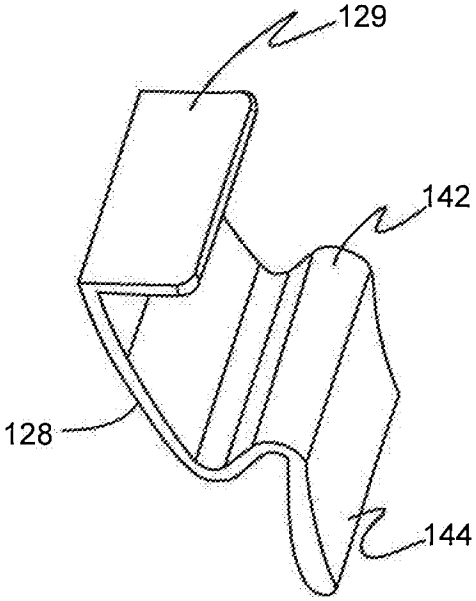
FIG. 17*a* is a perspective view of the locking tab or clip of the fifth embodiment.

FIGS. 15-17 are piece part drawings for the rear lid portion, front lid portion and locking tab or clip, respectively, of the fifth embodiment of the lid.

While various embodiments of the present invention have been shown and described, it should be understood that other modifications, substitutions, and alternatives are apparent to one of ordinary skill in the art. It is also contemplated that the various embodiments shown and described can be combined. For example, the recessed central lid portion of the second embodiment can be provided in the fifth embodiment. Also, the non-integral locking tab shown in FIG. 14 can be used in combination with the any of the first four embodiments. Such modifications, substitutions, combinations and alternatives can be made without departing from the spirit and scope of the invention.

What is claimed is:

1. A lid for a bucket having a rim channel and plural bail mounts in the rim channel, the lid comprising:

a substantially rigid rear lid portion with a top surface and a bottom surface;

a substantially rigid front lid portion hingedly connected to the rear lid portion so that it can be pivoted between open and closed positions, the front lid portion having a top surface and a bottom surface, peripheral margins of the bottom surfaces of the rear and front lid portions being configured to engage the rim channel of the bucket when the lid is attached to the bucket; and plural cut outs in the peripheral margins of at least one of the rear and front lid portions configured to receive, respectively, the plural bail mounts;

wherein the hinged connection between the front and rear lid portions is offset from a center of the lid such that the area of the front lid portion is greater than the area of the rear lid portion.

2. A lid as in claim 1, wherein the bucket has a semi-circular configuration with a flat back, and wherein the rear lid portion has a semi-circular configuration with a flat back that is configured to match the flat back of the bucket.

3. A lid as in claim 1, wherein the plural cut outs are in the peripheral margins of the rear lid portion.

4. A lid as in claim 3, wherein the bucket has a flat back, and wherein the rear lid portion has a flat back that is configured to match the flat back of the bucket, and the plural cut outs are on a first axis that is parallel to the flat back of the rear lid portion.

5. A lid as in claim 4, wherein the hinged connection between the rear lid portion and the front rear lid portion lies on a second axis that is substantially parallel to and in between the first axis and the flat back of the rear lid portion.

6. A lid as in claim 1, further comprising a plurality of removable clips configured secure at least the rear lid portion to the rim channel of the bucket.

7. A lid as in claim 1 further comprising at least one lip extending from the rear lid portion, said lip positioned to be exterior of and overhang the rim channel of the bucket.

8. A lid as in claim 7 further comprising at least one rib on the bottom surface of the rear lid portion positioned to be interior of the rim channel, wherein the at least one rib and the lip of the rear lid portion are configured to receive the upper rim of the bucket there between.

9. A lid as in claim 1 further comprising lips extending from both the rear lid portion and the front lid portion, said lips positioned to be exterior of and overhang the rim channel of the bucket.

10. A lid as in claim 9 further comprising ribs on the bottom surfaces of the rear lid portion and the front lid portion, said ribs positioned to be interior of the rim channel of the bucket, wherein the ribs and the lips of the rear lid portion and the front rib portion are configured to receive the rim channel of the bucket there between.

11. A lid for a semi-circular bucket having a flat back, a rim channel and plural bail mounts in the rim channel, the lid comprising:

a semi-circular configuration with a flat back to match the bucket configuration;

a rear lid portion with a top surface, a bottom surface and a flat back that is configured to match the flat back of the bucket;

a front lid portion hingedly connected to the rear lid portion so that it can pivot between open and closed positions, the front lid portion having top and bottom surfaces;

a plurality of tabs configured to secure at least the rear lid portion to the rim channel of the bucket;

a plurality of ribs arranged on the bottom surface of the front and rear lid portions interior of the rim channel when the lid is secured to the bucket rim channel;

plural cut outs in the rear lid portion configured to receive, respectively, the bail mounts, the plural cut outs being positioned on a first axis that is parallel to the flat back of the rear lid portion, wherein the first axis is coincident with the center of the semi-circular configuration of the lid; and lips extending from the front lid portion and rear lid portion and arranged so that the lips will be exterior of and overhang the rim channel of the flat back bucket when the lid is secured to the bucket;

wherein the hinged connection between the rear lid portion and the front rear lid portion lies on a second axis that is substantially parallel to the first axis and the flat back of the rear lid portion, and the second axis is off-set from the center of the semi-circular configuration and lies between the first axis and the flat back of the rear lid portion, and wherein the area of the front lid portion is substantially larger than the area of the rear lid portion.

12. A lid as in claim 11 wherein the bail mount cutouts are only in the rear lid portion.

* * * * *